United States Patent [19]

Hall

[11] Patent Number: 5,050,830

[45] Date of Patent: Sep. 24, 1991

[54] DETACHABLE GOLF SCORECARD HOLDER

[76] Inventor: Lawrence Hall, P.O. Box 1975, Truckee, Calif. 95718

[21] Appl. No.: 588,565

[22] Filed: Sep. 26, 1990

[51] Int. Cl.[5] ..... A44B 1/18

[52] U.S. Cl. ..... 248/205.2; 224/901; 224/918; 248/231.8; 248/316.7

[58] Field of Search ..... 224/901, 274, 918, 277, 224/247; 273/32 D; 40/642; 211/70.2; 248/205.2, 231.8, 690, 689, 316.7

[56] References Cited

U.S. PATENT DOCUMENTS

| | | | |
|---|---|---|---|
| 2,802,250 | 8/1957 | Klotz | 224/918 X |
| 3,010,628 | 11/1961 | Kowalczyk | 224/274 |
| 3,830,415 | 8/1974 | Jacobson et al. | 224/918 X |
| 4,069,954 | 1/1978 | Rauch | 224/901 X |
| 4,157,152 | 6/1979 | Blastic | 224/247 |
| 4,449,310 | 5/1984 | Kline | 224/918 X |
| 4,498,615 | 2/1985 | Johnson | 224/901 X |
| 4,512,504 | 4/1985 | Owlett | 224/277 X |
| 4,548,375 | 10/1985 | Moss | 248/205.2 |
| 4,625,862 | 12/1986 | Clayton | 224/901 X |
| 4,645,105 | 2/1987 | Plumbridge | 224/269 |
| 4,699,303 | 10/1987 | Kline | 224/918 X |
| 4,746,045 | 5/1988 | Schweim | 224/274 |
| 4,953,770 | 9/1990 | Bond, Sr. | 224/901 X |

*Primary Examiner*—Ramon O. Ramirez
*Attorney, Agent, or Firm*—Robert Charles Hill

[57] ABSTRACT

A detachable golf scorecard holder comprising a scorecard holder (10), and a bag clip (5). A fastening system utilizing hook (8) and loop (4) material for removing and replacing the scorecard (10) from the bag clip (5) and golf bag (1). In addition, accessories including: a pencil (12), a tee (15), and a ball marker (18). Accessories also utilize said hook and loop material as a fastening system.

6 Claims, 2 Drawing Sheets

DETACHABLE GOLF SCORECARD HOLDER

BACKGROUND

1. Field of Invention

This invention relates to scorecard holders, specifically to such holders as used in the game of golf.

2. Description of Prior Art

As most golfers carry their own scorecards, the need for a convenient system to record scores is valuable to the scorekeeper. For some, the act of scorekeeping may be an added distraction to the game. The chosen scorekeeper must refer to the scorecard at least once every hole, and must provide it to his fellow players on demand.

The majority of golf scorecard holders fall into three categories. The first is a permanent holder as found on powered golf carts. These work fine for the situation, but still are not detachable as a unit with the pencil for various recall situations. As powered carts must be driven in only specified paths or areas, the golfers accessories are also tied to the golf cart, often some distance from the ball.

The second is a type that permanently clamps onto the handle of a typical manual pull cart. This type is not easily detachable as a unit with the pencil and accessories, and is also bulky. Additionally, many golfers do not bring their manual golf carts on vacation. Rental manual carts do not, in general, have scorecard holders. The bulkiness of this type of scorecard holder is inconvenient to remove and pack in the golf bag.

The third, and most recent type of scorecard holder is basically a small clipboard with pencil and accessory attachments. This type still has the disadvantage of either being permanently tied to the golf bag, or not conveniently removable. Current removable golf scorecard holders fall short of convenience by design as seen in the following discussion.

U.S. Pat. No. 4,157,152 to Blastle (1979) discloses a golf scorecard holder with writing board. This scorecard and pencil holder is a basic clipboard design, with the additon of a hook for attachment to the golf bag. The disadvantages of this type of scorecard detract from it's potential convenience. The golfbag clip must be aligned to the proper position every time the scorecard is replaced. Golf clubs may have to be moved to allow the clip to slide freely over the top of the bag. The metal clip may also scratch the golf clubs.

U.S. Pat. No. 4,645,105 to Plumbridge (1987) has similar design problems. He also uses a clip to attach and remove the scorecard holder. His clip is made of plastic and has the advantage of not scratching golf clubs. But the scorecard and clip must be aligned every time it's replaced with the possibility of having to move golf clubs out of the way. Both of these designs have the disadvantage of having the golf bag clip integrated into the scorecard holder. It is a bulky design to be stored in a golf bag.

U S. Pat. No. 4,746,045 to Schweim (1988) sets itself apart from the clipboard design. It is a complicated design that has it's own unique disadvantages. First, his attachment to the golf bag is a clamping ring. If the golf bag does not have a hole or loop for the clamping ring, the scorecard holder cannot be attached, unless a hole is drilled in the bag. This design also limits where the scorecard holder may be attached. Second, the method of recording the score is complicated and inconvenient. This includes five steps. Unfortunately in his desire to waterproof the scorecard, he made the act of writing down the score, inconvenient. Third, non standard sized scorecards will not fit into his scorecard holder. Fourth, large pencils will not fit into his pencil holder.

OBJECTS AND ADVANTAGES

Several objects and advantages of the present invention are:

(a) to provide a convenient method of keeping golf scores, including removing and replacing the scorecard holder from the golf bag, and the pencil from the scorecard holder;

(b) to provide a golf scorecard holder that may be removed and replaced by a simple push or pull;

(c) to provide a golf scorecard holder that utilizes a fastening system of hook and loop material;

(d) to provide a golf scorecard holder which is made of plastic and other soft materials, and has no metal parts;

(e) to provide a simple golf scorecard holder which has no mechanical moving parts to wear out or break;

(f) to provide a golf scorecard holder that will separate from a golf bag clip to provide a compact design that may easily be stored in a golf bag;

(g) to provide a golf scorecard holder that will accommodate golf accessories without increasing the basic size of the scorecard holder, and will allow for different combinations of said accessories.

Further objects and advantages will become apparent from the following description and drawings.

DRAWINGS FIGURES

REFERENCE NUMERALS IN DRAWINGS

Figure 1:
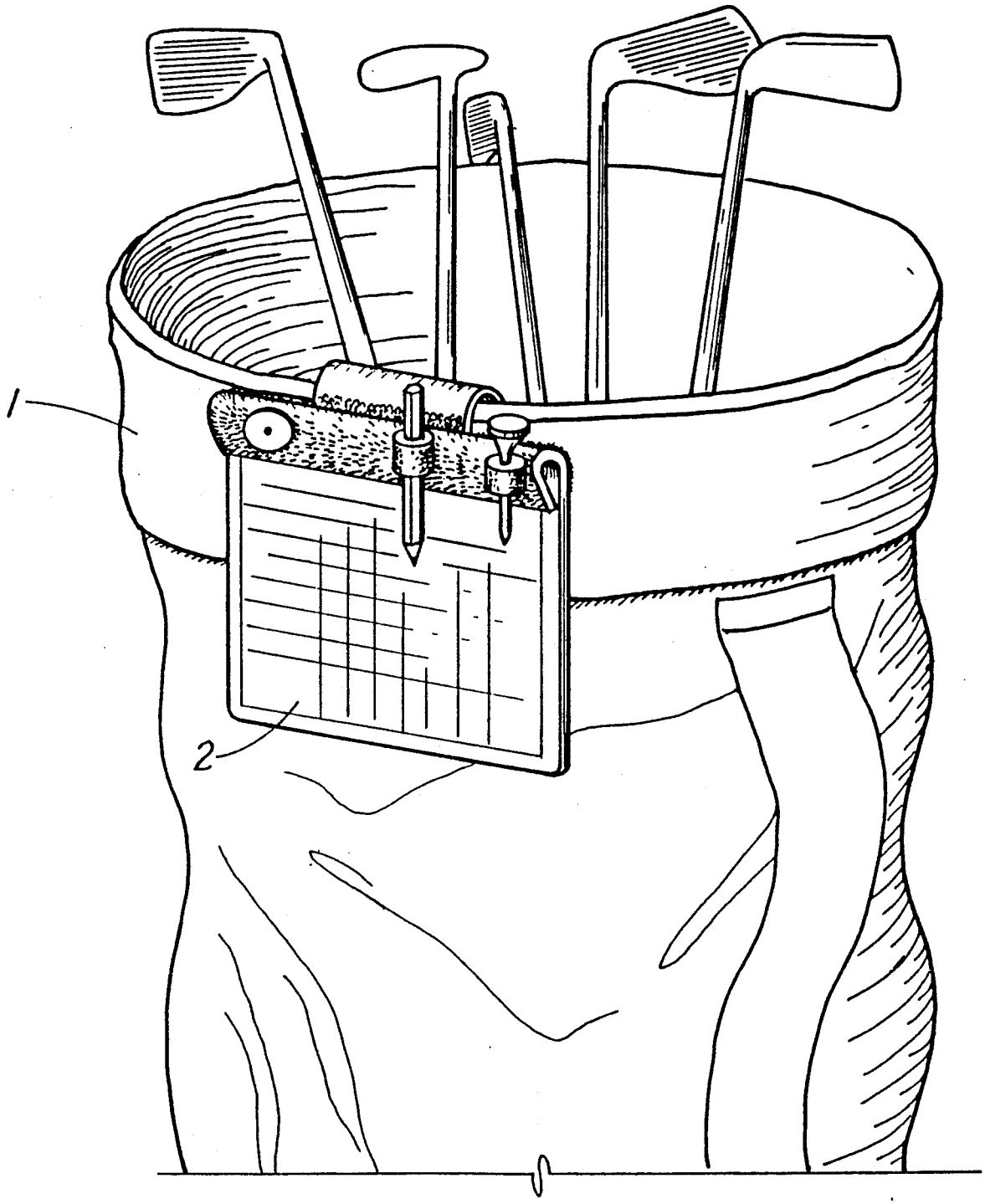
FIG. 1 is a view of the golf scorecard holder and bag clip attached to a golf bag.

1 golf bag
2 scorecard and bag clip
3 bag clip
4 loop material
5 inner side of bag clip
6 writing surface of scorecard holder
7 scorecard holder curl with attached hook material
8 back of scorecard holder with attached hook material
9 pressure point of scorecard holder on scorecard
10 score card holder
11 side opening of curl on scorecard holder
12 pencil accessory
13 pencil
14 attached loop material on pencil
15 tee accessory
16 tee
17 tee holder with attached loop material
18 ball marker accessory
19 loop material attached to ball marker
20 scorecard

DESCRIPTION—FIGS. 1 AND 2

A view of the scorecard and bag clip 2 in FIG. 1 shows the attached position to the golf bag 1. The scorecard and bag clip 2 may be positioned at any point around the top circumference of the golf bag 1.

Figure 2:
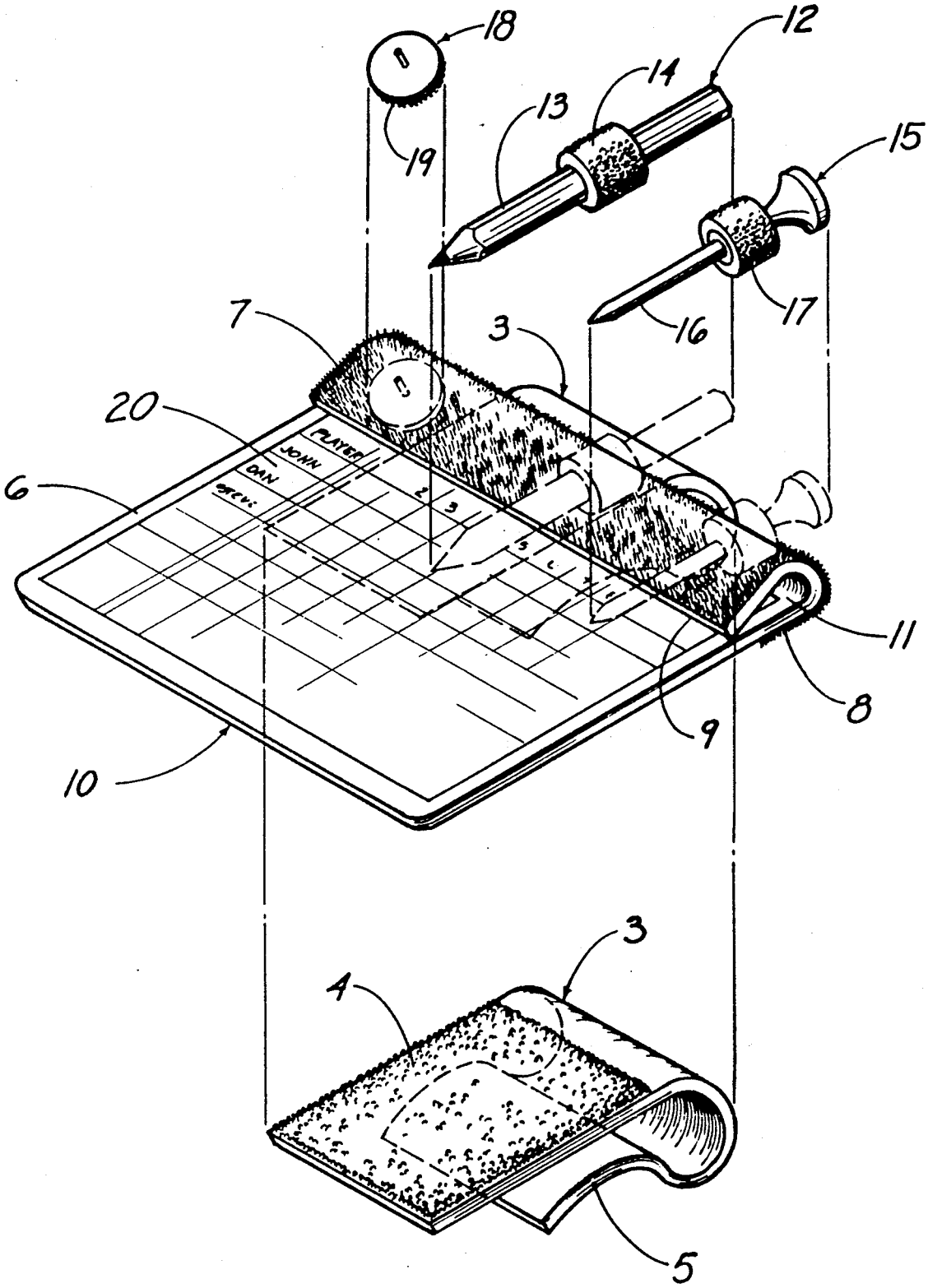
FIG. 2 is an exploded view of the complete golf scorecard holder and bag clip with attached accessories.

A view of the bag clip 3 in FIG. 2 shows the attached loop material 4 and interior side 5. The scorecard writing support surface 6 folds over on itself to form the scorecard curl 7. Numeral 8 is the is the hook covered portion of the back of the scorecard holder.

The scorecard pressure point 9 holds the scorecard 20 in place on the scorecard holder 10. The side opening of the scorecard holder curl 11, is used for sliding the sorecard 20 onto the scorecard holder 10.

The pencil accessory 12 includes the pencil 13 and attached loop material 14. The tee accessory 15 includes the tee 16, and the attached loop covered tee holder 17. The ball marker accessory 18 has attached loop material 19.

OPERATIONS—FIG. 1 AND 2

Through the use of the simple fastening system, incorperating hook and loop material, the operation of the present invention is very simple. First, the bag clip 3 is slipped over the top of the golf bag 1, where it may permanently remain. The loop covered side 4 of the bag clip 3 faces outward of the golf bag 1. The scorecard 20 is slipped through the curl opening 11, and positioned on the scorecard holder 10 as shown in FIG. 2.

The scorecard holder 10 is now ready for use. By simply pushing the scorecard holder 10 up against the bag clip 3, so that the hook material 8 contacts the loop material 4, attachment is made. Simply pulling on the scorecard holder 10 will detach it from the bag clip 3.

The pencil accessory 12 is easily removed and replaced by a simple push or pull by contacting or releasing the loop material on the pencil 14 with the hook material 7 on the scorecard holder 10. In a similar fashion the ball marker 18 may be attached and released through contact of loop material 19 and hook material 7.

The tee accessory works differently. The looped covered tee holder 17 remains on the scorecard holder 10. The tee 16 slides in and out of the tee holder 17 when replaced or removed.

The scorecard 20 may be removed from the scorecard holder 10 by pulling it out of the curl opening 11.

It must be noted that the placement of hook and loop material may reverse locations with the mating combination remaining intact.

SUMMARY, RAMIFICATION, AND SCOPE

From the previous descriptions and drawings, it may be seen that the present invention is both convenient and simple. It is an improvement in both design and materials over the currently available golf scorecard holders. Futhermore, the detachable golf scorecard holder has the additional advantages in that it provides a convenient golf scoring system through the use of fastening hook and loop material;

it permits the scorecard to be removed and replaced from the golf bag by a simple pull and push;

it provides a simple, compact scorecard that may be easily stored in the golf bag when not in use;

it provides a scorecard holder and golf bag clip that contain no metal parts that may rust or scratch golf clubs;

it provides a scorecard holder and golf bag clip that contain no mechanical moving parts to wear out or break;

it provides a golf scorecard holder that will accommodate golf accessories without increasing the basic size of the scorecard holder, and will allow for different combinations of said accessories.

Although the above description contains specific qualities of the golf scorecard holder, these qualities should not be construed as limiting the scope of the invention. They may be viewed as a preferred embodiment of this invention. Variations of the shape of the scorecard holder and bag clip are possible without changing the basic design and function of the invention. Also, a variation as reversing the combination of hook and loop material should not be seen as changing the scope of the invention.

Thus the scope of the invention should be determined by the following claims and their legal equivalents, and not by the examples given.

I claim:

1. A golf scorecard and accessory holder which comprises:

a resilient support sheet having an edge and an edge region along said edge that is curled back against a remaining flat region of said support sheet thereby forming a convex surface and providing that a score card may be detachably secured between said edge and said remaining flat portion and permitting that said remaining portion may support said scorecard when it is desired to write on said scorecard;

a resilient strap bent to form a U-shaped clip having a convex surface opposite adjacent concave surfaces thereby providing that said clip may be hooked onto the lip of a golfbag positioned between said concave surfaces;

said convex surfaces of said clip and said sheet having a preparation in operable combination to provide that said convex surfaces will detachably adhere to one another when brought into contact when it is desired to store said scorecard attached to said sheet with said golfbag and permit detaching said sheet from said clip to enable a user to conveniently write on said scorecard supported by said sheet.

2. A holder as in claim 1 wherein said preparation in operable combination comprises one of said convex surfaces being provided with a hook texture and another of said convex surfaces being provided with a loop texture.

3. A holder as in claim 1 which further comprises:

at least one cylinder having a bore and an outer surface;

said outer surface having a preparation in operable combination with said convex surface of said sheet to provide that said at least one cylinder may be detachably secured to said convex surface of said clip thereby providing that accessories may be stored with said scorecard holder when said cylinders are attached to said sheet by inserting said accessories into said bores.

4. A holder as in claim 3 wherein said preparation in operable combination is a hook texture on one and a loop texture on another of said convex and outer surfaces.

5. A holder as in claim 3 wherein said accessories are selected from the group that includes pencils and golf tees.

6. A holder as in claim 1 wherein said sheet and strap are plastic.

* * * * *